US006725559B2

(12) United States Patent
Burt, Jr.

(10) Patent No.: US 6,725,559 B2
(45) Date of Patent: Apr. 27, 2004

(54) APPARATUS AND METHODS FOR LOCATING EMBROIDERY CENTER MARKS ON AN ARTICLE

(76) Inventor: Robert S. Burt, Jr., 1045 Phillips Hill Rd., Columbus, MS (US) 39702

( * ) Notice: Subject to any disclaimer, the term of this patent is extended or adjusted under 35 U.S.C. 154(b) by 0 days.

(21) Appl. No.: 10/145,688

(22) Filed: May 16, 2002

(65) Prior Publication Data

US 2003/0213140 A1 Nov. 20, 2003

(51) Int. Cl.[7] ..... G01D 21/00

(52) U.S. Cl. ..... 33/653; 33/645; 33/644; 33/613; 33/487; 33/11; 33/12; 33/13; 33/494; 33/679.1; 33/474; 33/476; 33/483; 33/485

(58) Field of Search ..... 33/653, 645, 644, 33/613, 487, 494, 679.1, 11, 12, 13, 474, 476, 483, 485

(56) References Cited

U.S. PATENT DOCUMENTS

| | | | | | |
|---|---|---|---|---|---|
| 513,665 | A | * | 1/1894 | Barberie | 33/474 |
| 999,425 | A | * | 8/1911 | Zaino | 33/11 |
| 1,663,895 | A | * | 3/1928 | Wolfe et al. | 33/11 |
| 1,763,091 | A | * | 6/1930 | Cangemi | 33/11 |
| 1,776,393 | A | * | 9/1930 | Onorato | 33/11 |
| 2,816,366 | A | * | 12/1957 | Barlow | 33/644 |
| 4,301,596 | A | * | 11/1981 | Sedlock | 33/494 |
| 4,302,884 | A | * | 12/1981 | Pallone | 33/653 |
| 5,251,382 | A | * | 10/1993 | Hellar | 33/487 |
| 5,505,002 | A | * | 4/1996 | Falco | 33/679.1 |
| 5,749,153 | A | * | 5/1998 | Viens | 33/474 |
| 6,101,729 | A | * | 8/2000 | Stringari | 33/474 |
| 6,216,617 | B1 | | 4/2001 | Burt, Jr. | |

* cited by examiner

*Primary Examiner*—Christopher W. Fulton
*Assistant Examiner*—Amanda J Hoolahan
(74) *Attorney, Agent, or Firm*—Nixon & Vanderhye

(57) ABSTRACT

The tool for locating a center mark for embroidery on articles such as garments includes a planar body having orthogonally-related legs with respective exterior and interior edges. Index markings are provided on the legs along the linear edges. The index markings include indicia identifying a plurality of corresponding preestablished garment sizes along the linear extending edges, respectively. By aligning common selected sizes along the edges with the vertical centerline of a folded garment and a shoulder portion of the garment, respectively, the location of the embroiderer's center mark on the garment is identified at the intersection of the linear edges. The interior edges of the tool may also used to form marking lines where conventional hoop grids are not available.

12 Claims, 4 Drawing Sheets

APPARATUS AND METHODS FOR LOCATING EMBROIDERY CENTER MARKS ON AN ARTICLE

BACKGROUND OF THE INVENTION

The present invention relates to apparatus and methods for consistently and correctly placing center marks for embroidery on an article and particularly relates to apparatus and methods for locating embroidery center marks on garments using standardized garment sizes or a custom size.

As well known in the embroidery industry, the portion of the article to be embroidered is typically placed within a matched pair of rings forming an embroidery hoop. While the matched embroidery rings can be a number of different sizes and shapes, the smaller or inner ring typically fits snugly inside the larger or outer ring with the material of the article pinched between the rings and stretched and maintained taut across the rings. Embroidery hoops conventionally ensure that the area of the article to be embroidered is stretched tightly between the hoop rings to ensure that the embroidery is even and not distorted.

Before the article can be embroidered in the area within the matched rings, and indeed before the rings can be applied to the article, the center of the embroidery must be identified and marked on the article, e.g., a garment. Once the center mark for the embroidery is identified, a number of different tools are conventionally used to align the matched rings such that the resulting embroidery is straight and not canted or angled or positioned above, below or to the right or left of the desired position.

For articles, particularly garments of various sizes, the problem of identifying the center mark for locating the embroidery is compounded by the difference in sizes. However, garments are typically provided in standard sizes. For example, on T-shirts, collared shirts, jackets or the like which are typically embroidered along the left or right chest portion of the garment, men's sizes may range, for example, between small, medium, large and extra large. Similarly, women's sizes may likewise be standardized in small, medium, large and extra large, with those predetermined sizes for each gender being generally different from one another. Thus, given a garment of a particular size, a center mark for the embroidery must first be determined. If a number of garments of the same or different sizes are to be embroidered, similar center marks for the embroidery for each garment are required. Heretofore, this has meant repeating the same process of identifying the center mark for each garment. Further, once the center mark for a garment is identified and marked on the garment, there is also the additional problem of aligning the embroidery with the garment where alignment tools are not utilized.

BRIEF DESCRIPTION OF THE INVENTION

In accordance with a preferred embodiment of the present invention, there is provided apparatus and methods for accurately and consistently locating a center mark on articles, e.g., garments to be embroidered and particularly for locating a center mark on garments folded along a vertical centerline for placement of the embroidery in the chest area of the garments. Particularly, a tool is provided comprised of a planar body having orthogonally-related legs having a first pair of orthogonally-related linear edges terminating at an intersection point along an outside edge of the tool. The legs of the tool include index markings along their linear edges, including indicia identifying a plurality of corresponding preestablished garment sizes. For example, both men's and women's sizes, small, medium, large and extra large, may be indicated along each of the outside edges of the tool at predetermined distances from the intersection point of those edges. With a garment folded along a vertical centerline, alignment of the indicia identifying a common selected size along the edges with the garment centerline and a garment shoulder portion, respectively, the location of the embroiderer's center mark on the garment is identified at the intersection of the outside linear edges. For example, when embroidering a man's medium T-shirt, the standard indicia identifying a man's medium size along a horizontal leg of the tool is aligned with the vertical centerline of the garment. An identical indicia along the vertical leg of the tool is aligned with the shoulder of the folded garment. The intersection of the edges identifies the center mark for the embroidery and can be placed on the garment. It will be appreciated that additional garments of the same size or different sizes can be marked by placement of the tool on each of the garments in similar fashion. Preferably, the intersection of the outside edges of the tool has a concave arcuate cutout which facilitates marking on the underlying garment.

With the center mark identified on the garment, various embroiderer's tools may be used without making alignment marks on the garment. However, if such tools are not used, alignment marks can be applied using the tool of the present invention. For example, after locating the center mark on the garment, a right angularly related end edge of the horizontal leg of the tool can be aligned with the vertical center line of the garment and with the previously identified center mark. A horizontal line is then scribed along the garment using the outside edge of the tool as a guide. By shifting the tool horizontally along the garment and aligning the inside corner of the orthogonally-related legs of the tool with the center mark and the horizontal line, a vertical line may be scribed on the garment using the inside vertical edge of the vertically extending leg of the tool. The two orthogonally-related lines scribed on the garment provide the necessary marks for aligning the hoop grid without the use of ancillary tools.

It will also be appreciated that custom embroidery center mark placement may also be accomplished with the tool hereof. Using a previously embroidered article that is placed correctly for an individual, the tool may be located on the article with the intersection or corner point of the tool located on the center of the embroidery. By marking the intersection of the vertical leg with the upper edge of the article, e.g., a garment shoulder fold, on the vertical leg and marking the intersection of the horizontal leg with the vertical edge of the article, e.g., the folded centerline of the garment, on the horizontal leg, the custom placement of center marks for embroidering on additional articles, e.g., garments, may be accomplished.

In a preferred embodiment according to the present invention, there is provided a tool for locating a center mark on garments folded along a vertical centerline for placement of embroidery on the garments, comprising a planar body having a first pair of orthogonally-extending linear edges terminating at an intersection point, index markings on the body spaced one from the other along and adjacent each of the linear edges, the body being flat along one side for placement on the garment in generally coplanar relation with the garment, the index markings including indicia identifying a plurality of corresponding preestablished garment sizes along the linear extending edges, respectively, whereby alignment of indicia identifying common selected sizes along the edges with the garment centerline and a garment shoulder portion, respectively, enables location of an embroiderer's center mark on the garment at the intersection of the linear edges.

In a further preferred embodiment according to the present invention, there is provided a method of locating an embroiderer's center mark on a garment folded along a vertical centerline using a tool having a planar body, a first pair of orthogonally-extending linear edges terminating at an intersection point and indicia identifying a plurality of corresponding preestablished garment sizes along each of the linear edges, comprising the steps of placing the body on the folded garment with the indicia identifying a common selected garment size in alignment with the garment centerline and shoulder portion of the garment, respectively, and marking the garment at the location of the intersection of the edges thereby identifying the center mark location for placement of embroidery on the garment.

In a further preferred embodiment according to the present invention, there is provided a method of marking a tool having first and second orthogonally-extending edges intersecting at a corner using a previously embroidered garment as a guide for identifying center marks for embroidering one or more additional garments, comprising the steps of folding the embroidered garment along a vertical centerline thereof, overlaying the tool on the embroidered garment with the corner of the tool overlaid on a center of the embroidery of the embroidered garment and marking the tool along the edges thereof at locations in alignment with the vertical centerline and a shoulder portion, respectively, of the embroidered garment thereby providing a pair of markings on the tool which, together with the corner of the tool, provide reference marks for identifying embroidery center marks on the one or more additional garments.

DETAILED DESCRIPTION OF THE INVENTION

Figure 1:
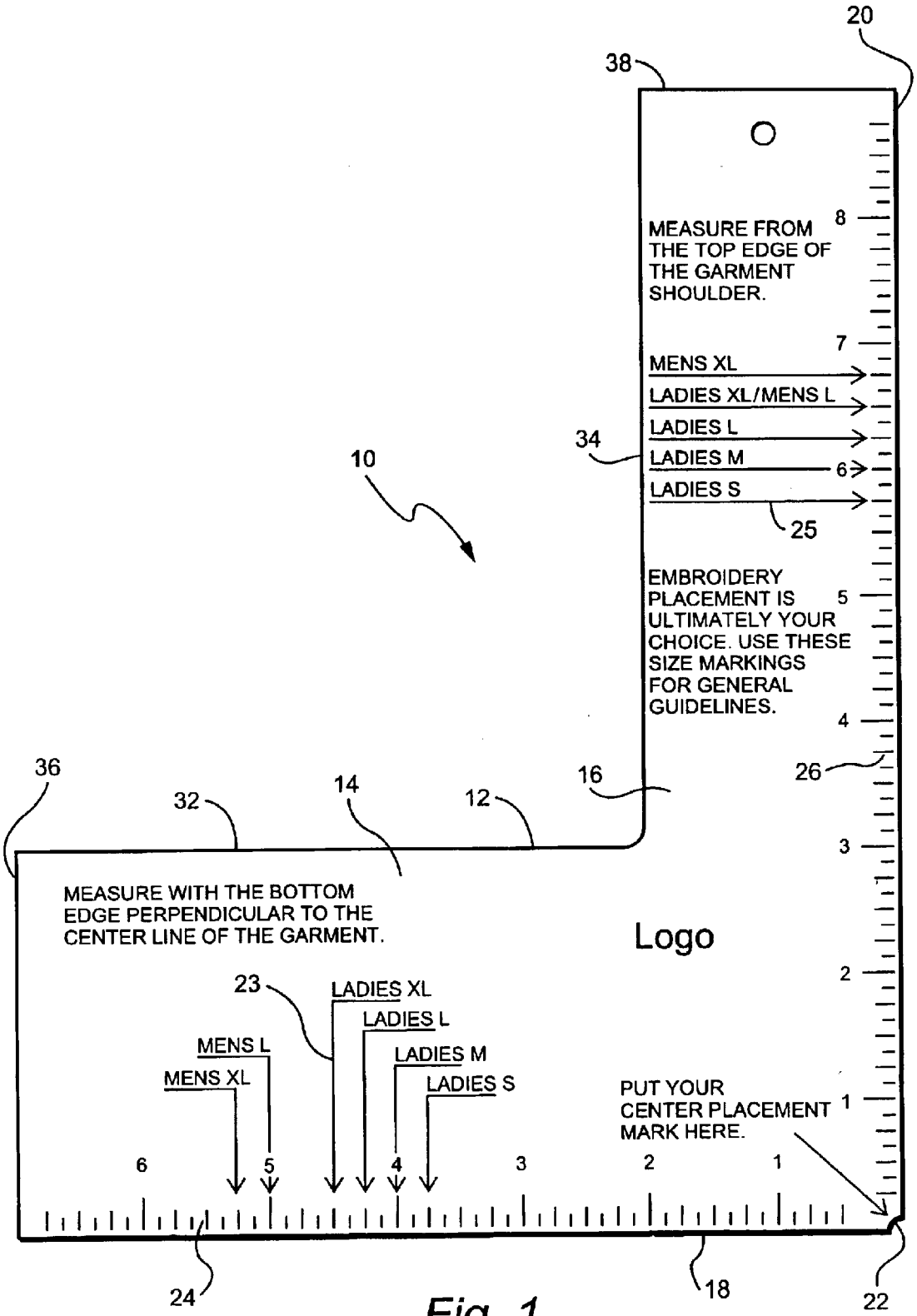
FIG. 1 is a plan view of a tool for identifying embroidery center marks on articles constructed in accordance with a preferred embodiment of the present invention.
Figure 2:
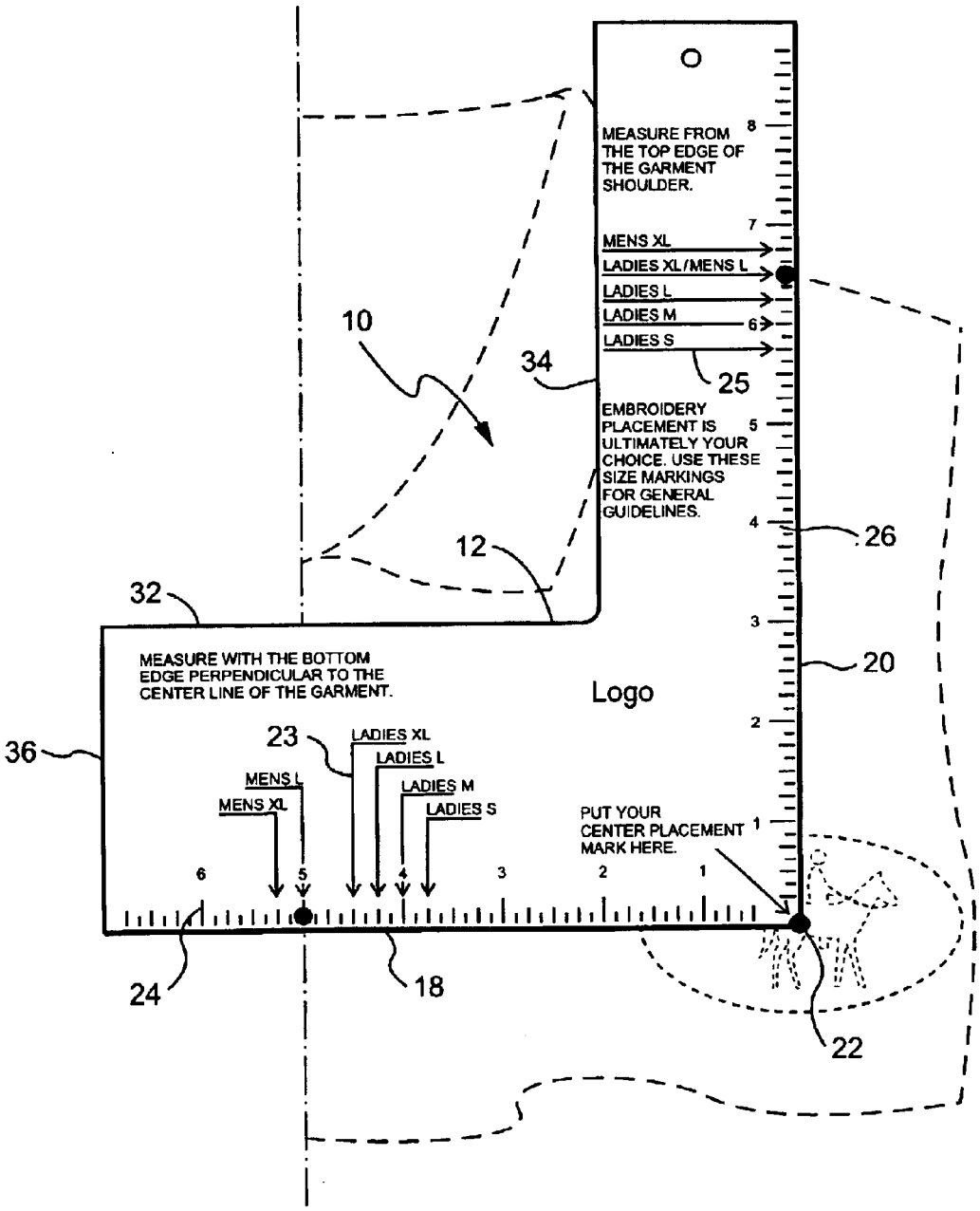
FIG. 2 is a view similar to FIG. 1 with the tool overlaid on a garment illustrating usage of the tool to identify a center mark for the embroidery.
Figure 4:
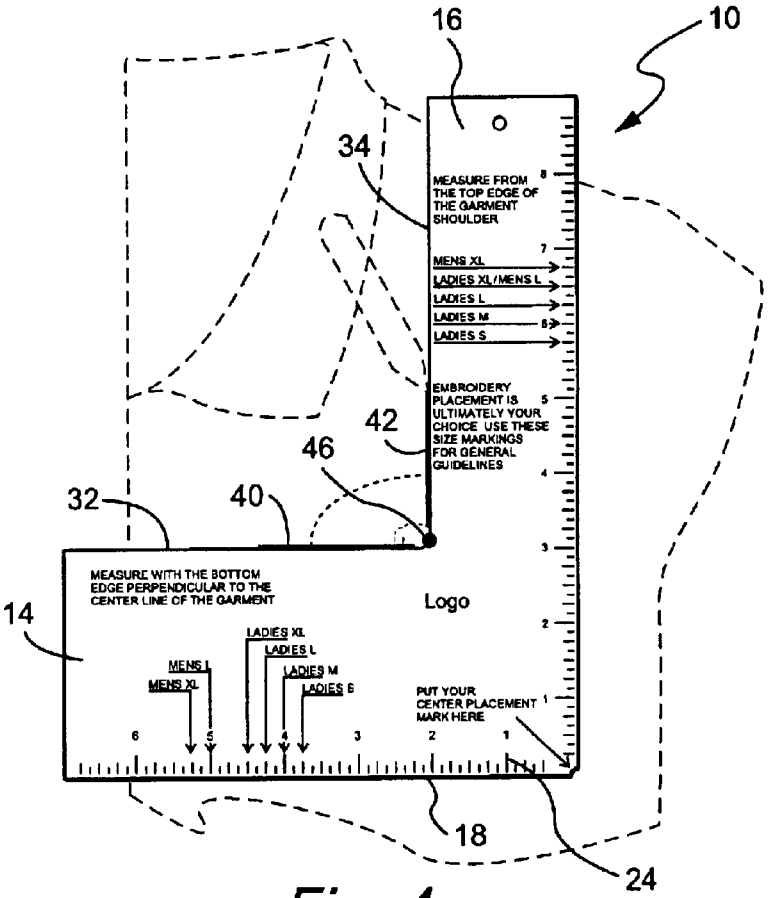
FIGS. 3 and 4 illustrate usage of the tool to locate alignment marks on the garment once the center mark has been identified on the garment.

Referring now to the drawings, particularly to FIG. 1, there is illustrated an embroiderer's tool, generally designated 10, constructed in accordance with a preferred embodiment of the present invention. Tool 10 includes a unitary planar body 12 having a pair of legs 14 and 16 orthogonally-related one to the other. As illustrated, each of the legs 14 and 16 have linear orthogonally-related outside edges 18 and 20, respectively. The edges 18 and 20 intersect one another at a point or outside corner of the tool defined by a concave surface 22 which, as described below, identifies the location of a center mark for the embroidery when the tool is applied to a garment.

The tool face along each of the edges is provided with index markings, for example, markings 24 and 26, at designated locations along the length of the edges measured from the intersection 22 of the edges. The indicia also includes a plurality of preestablished garment sizes 23 and 25 marked along the tool face adjacent the edges. For example, along the horizontal edge 18, there is identified a series of different predetermined sizes for each gender. Thus, ladies' sizes small, medium, large and extra large, designated by ladies' S, M, L and XL indicia 23, are provided at various distances from an end or third edge 30 of the tool 10. That is, the predetermined sizes which are sizes standard to many garments decrease in size upon increasing distance along the horizontal leg 14 from the edge 30. Similarly, corresponding predetermined garment sizes are provided at various distances from an end or fourth edge 38 of the vertical leg, the standard sizes decreasing from XL to S with increasing distance from end edge 38. It will also be appreciated that the legs 14 and 16 have inside edges 32 and 34, respectively, which parallel the edges 18 and 20, respectively. Leg 14 includes an end edge 36 perpendicular to edges 18 and 32, while leg 16 includes an end edge 38 perpendicular to edges 20 and 34.

Figure 3:
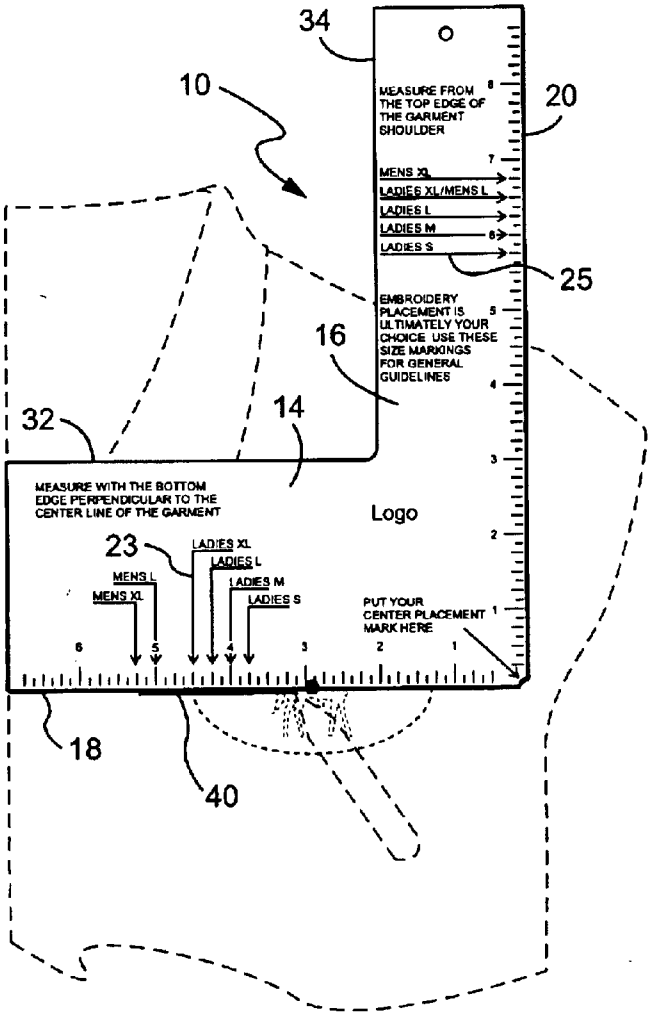

The following description will describe the multiple uses of the tool 10. To locate the center mark for embroidery placement on plain garments, such as T-shirts, which typically are provided in preestablished garment sizes, the garment is first folded along a vertical centerline and preferably laid on a flat surface. The tool 10 is then placed in overlying, i.e., co-planar relation, to the folded garment and on the folded side thereof upon which the embroidery will be applied. The tool 10 is located such that the indicia identifying the preestablished garment size along the horizontal leg 14 adjacent edge 18 is aligned with the vertical centerline of the garment. The vertical leg 16 of the tool 10 is located along the garment such that the indicia identifying the same preestablished garment size along the vertical leg 16 adjacent edge 20 is aligned with the folded shoulder of the garment. With the alignment of the corresponding preestablished garment sizes along the legs 14 and 16 with the vertical centerline and shoulder, respectively, of the garment, the intersection of the edges 18 and 20 at corner 22 defines the center mark for the embroidery. The garment may then be marked at corner 22 with a marking pen or an adhesive dot may be applied to the garment at. the notched corner 22 of the tool 10. The garment is now ready to be hooped, using various tools for hooping, where alignment marks are not necessary, as those conventional tools perform the alignment function.

Where such conventional alignment tools are not available or used, the tool 10 may also be employed to provide the alignment lines. To accomplish this, the end edge 30 of horizontal leg 14 is aligned with the centerline fold of the garment and the edge 18 is aligned with the previously located center mark for the embroidery on the garment. Using a marking pen, a line 40 (FIG. 3) is drawn along the garment parallel to the edge 18. Next, the tool 10 is displaced such that the intersection of the interior edges 32 and 34 at interior corner 46 is located at the center mark on the garment and the interior edge 32 of the tool 10 is aligned with the marked line 40. With this alignment, a vertical line is marked on the garment along the inside edge 34 of the tool. The orthogonally-related marking lines 40 and 42 provide the necessary marks for aligning the garment with the hoop grid.

A previously embroidered garment may also be used in connection with tool, 10 to accurately and consistently identify the center marks on one or more additional garments of the same size for embroidery placement. To accomplish this, the embroidered garment is folded about its vertical centerline and the corner 22 of tool 10 is located over the center of the embroidered garment. The horizontal and vertical legs 14 and 16 of tool 10 are then marked along edges 18 and 20 at their respective intersections with the garment's vertical centerline and the shoulder. The tool may then be marked using a grease pencil or adhesive dots may be applied to the legs of the tool. With the tool thus marked, the center marks for embroidering one or more additional garments may be identified as previously described.

Figure 5:
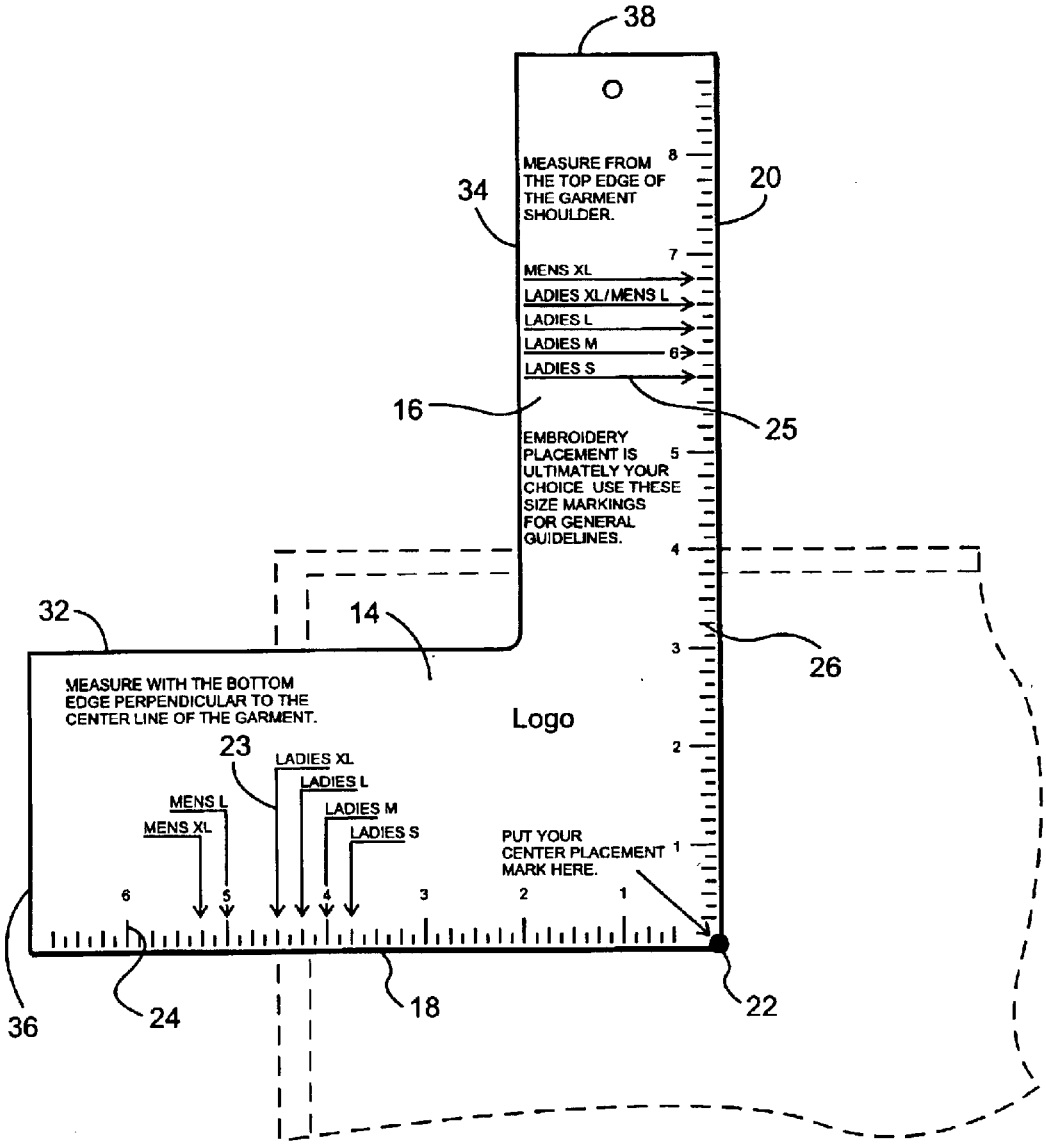
FIG. 5 is a view similar to FIG. 1 illustrating use of the tool on articles having rectilinear edges, such as napkins and placemats.

The graduations 24 may also be employed for identifying the center mark for embroidering plain items such as towels, placemats, napkins and the like. For example, and as illustrated in FIG. 5, the tool 10 may be placed along the flat article with the appropriate graduations 24 aligned with the typically rectilinear edges, respectively, of the article. Thus, the center mark for the embroidery may be placed equidistant from the orthogonal edges of the article or at unequal distances from the edges of the article as determined by the graduations. Alternatively, for embroidery placement on the centerline of the article, the article can be folded about a vertical or horizontal centerline and the graduations used along one of the legs used for measuring the distance from the edge to the center mark.

It will be appreciated that if embroidery on garments is to be employed on both left and right sides of the garment, the location of the embroidery center mark as described previously with respect to the left side of the garment can readily be transposed to the right side. This is accomplished simply by first locating the center mark on the left side of the garment and inserting a straight pin through the center mark through the opposite side of the garment to locate the center mark on the opposite or right side of the garment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An embroidery center mark locating tool for locating a center mark on garments folded along a vertical centerline for placement of embroidery on the garments, comprising:

a planar body having a first pair of orthogonally-extending linear edges terminating at an intersection point;

index markings on said body spaced one from the other along and adjacent each of the linear edges;

said body being flat along one side for placement on the garment in generally coplanar relation with the garment;

said index markings including indicia identifying a plurality of corresponding preestablished garment sizes along the linear extending edges, respectively, whereby alignment of indicia identifying common selected sizes along said edges with the garment centerline and a garment shoulder portion, respectively, enables location of an embroiderer's center mark on the garment at said intersection of said linear edges.

2. A tool according to claim 1 wherein the intersection of the linear edges includes a concave surface between said edges enabling placement of a circular dot at the center mark.

3. A tool according to claim 1 wherein said tool has a distal end edge generally perpendicular to one of said linear extending edges, said preestablished garment sizes along said one edge identifying decreasing preestablished garment sizes in a direction away from said end edge.

4. A tool according to claim 1 wherein said index markings include graduations for making measurements along the garment.

5. A tool according to claim 1 wherein said body is generally L-shaped in said plane with a second pair of linear edges extending generally parallel to the first pair of edges, respectively, and spaced therefrom along opposite edges of the body.

6. A tool according to claim 1 wherein said tool has a pair of orthogonally-related legs in part defining said edges, respectively, each leg having a distal end edge perpendicular to a respective one of the legs of said pair thereof, said preestabhshed garment sizes along said edges of said first pair thereof identifying decreasing preestablished garment sizes in directions away from the respective end edges.

7. A tool according to claim 6 wherein the intersection of the linear edges includes a concave surface between said edges enabling placement of a circular dot at the center mark.

8. A tool according to claim 6 wherein said index markings include graduations for making measurements along the garment.

9. A tool according to claim 1 including indicia on said body identifying the location of the center mark.

10. A method of locating an embroiderer's center mark on a garment folded along a vertical centerline, comprising the steps of:

providing a tool having a planar body, a first pair of orthogonally-extending linear edges terminating at an intersection point and indicia identifying a plurality of corresponding preestablished garment sizes along each of the linear edges;

placing the body on the folded garment with the indicia identifying a common selected garment size in alignment with the garment centerline and shoulder portion of the garment, respectively; and marking the garment at the location of the intersection of the edges thereby identifying the center mark location for placement embroidery on the garment.

11. A method according to claim 10 wherein the tool has a second pair of orthogonally-extending linear edges extending generally parallel to the first pair of edges, respectively, and spaced therefrom along opposite sides of the body and a third edge perpendicular to first parallel edges of said first and second pairs of edges, including the step of forming alignment lines on the garment for use with an embroidery hoop grid by aligning said third edge with the centerline of the folded garment and a first edge of said first pair of edges with said center mark, marking a first line on the garment along said first edge of said first pair of edges, displacing the body to align an intersection of said second pair of edges with the center mark on the garment and with said first edge of said second pair of edges aligned along said first marked line on the garment, marking a line along a second edge of said second pair of edges thereby providing a pair of orthogonally-related marking lines on the garment for use with an embroidery hoop.

12. A method of marking a tool having first and second orthogonally-extending edges intersecting at a corner using a previously embroidered garment as a guide for identifying center marks for embroidering one or more additional garments, comprising the steps of:

folding the embroidered garment along a vertical centerline thereof;

overlaying the tool on the embroidered garment with the corner of the tool overlaid on a center of the embroidery of the embroidered garment; and marking the tool along the edges thereof at locations in alignment with the vertical centerline and a shoulder portion, respectively, of the embroidered garment thereby providing a pair of markings on the tool which, together with the corner of the tool, provide reference marks for identifying embroidery center marks on the one or more additional garments.

* * * * *